US005711419A

United States Patent [19]

Beales et al.

[11] Patent Number: 5,711,419

[45] Date of Patent: Jan. 27, 1998

[54] PAPERBOARD BOTTLE CARRIER

[75] Inventors: Jonathan T. Beales, Memphis; Walter A. Krajci, Germantown, both of Tenn.

[73] Assignee: International Paper, Purchase, N.Y.

[21] Appl. No.: 291,068

[22] Filed: Aug. 17, 1994

[51] Int. Cl.[6] ..... B65D 71/00; B65D 75/00

[52] U.S. Cl. ..... 206/148; 206/151; 206/158; 206/147; 206/199

[58] Field of Search ..... 206/147, 153, 206/161, 427, 145, 148, 158, 151, 152, 162, 194, 199, 143; 294/87.2, 87.26

[56] References Cited

U.S. PATENT DOCUMENTS

| | | | |
|---|---|---|---|
| 2,299,625 | 10/1942 | Holmes | 294/87.2 X |
| 2,737,326 | 3/1956 | Toensmeier | 294/87.2 |
| 2,823,063 | 2/1958 | Toensmeier | 206/158 X |
| 2,828,047 | 3/1958 | Weiselberg . | |
| 3,046,711 | 7/1962 | Harrison | 206/158 X |
| 3,073,644 | 1/1963 | Baker et al. | 294/87.2 |
| 3,085,683 | 4/1963 | Harrison . | |
| 3,156,858 | 11/1964 | Rondrup | 294/87.2 X |
| 3,394,800 | 7/1968 | Brackett . | |
| 3,524,671 | 8/1970 | Akeireb | 294/87.2 |
| 3,612,266 | 10/1971 | Graser | 206/158 X |
| 3,767,041 | 10/1973 | Graser . | |
| 4,190,149 | 2/1980 | Oliff . | |
| 4,621,734 | 11/1986 | Heijnen . | |
| 4,736,977 | 4/1988 | Killy | 294/87.2 |
| 5,186,321 | 2/1993 | Fadus | 206/151 |
| 5,246,113 | 9/1993 | Schuster . | |

*Primary Examiner*—Paul T. Sewell
*Attorney, Agent, or Firm*—Michael J. Doyle

[57] ABSTRACT

A bottle carrier is formed of one or more panels of paperboard and includes a plurality of bottle neck receiving openings. The periphery of each opening is defined by the tips of a plurality of radially extending fingers, the tips engaging beneath a portion of an abutment associated with each bottle neck. Each finger is bent upwardly at about 45 degrees after insertion of a bottle into a respective opening. Each radial finger is provided at its widest portion with a base slit extending thouugh the paperboard. Another and intermediate slit is located about half way along the length of each finger, the intermediate slit also extending through the paperboard. These slits are of lesser width than that of their respective fingers and are parallel to each other and are at right angles to the length of the finger. The base slit permits bending of each finger upwardly upon bottle insertion, while the intermediate slit facilitates removal of each bottle from its respective opening.

8 Claims, 2 Drawing Sheets

PAPERBOARD BOTTLE CARRIER

BACKGROUND OF THE INVENTION

This invention relates to bottle carriers of the type fashioned from one or more planar sheets of paperboard, the sheet having a plurality of openings for receiving respective bottles. Each bottle receiving opening has a plurality of radially outwardly extending fingers defined by cuts through the paperboard. In general, such carriers have been used largely for cans. Examples of constructions of this general type are shown in U.S. Pat. No. 3,834,750 issued to Gauntlett, U.S. Pat. No. 3,156,358 issued to Randrup, and U.S. Pat. No. 5,125,506 issued to Galbierz et al.

While planar paperboard bottle carriers have been widely employed for carrying cans, such as soft drink cans or the like, they have not been widely accepted for carrying plastic bottles having integral annular flanges around their necks. Generally, the annular flanges associated with bottles, or the screw caps on bottles, are so much larger in diameter than the diameter of the openings in the planar carrier that it is difficult to remove a bottle from its respective opening.

SUMMARY OF THE INVENTION

According to the practice of this invention, each of the radially extending fingers of each bottle opening is provided with two parallel slits extending through the paperboard. One slit is termed the base slit and is located at the widest part or base of the finger and the other or intermediate slit is located about half way along the finger length. The slits are at right angles to the longitudinal axis of each finger. The base slit permits upward bending of each finger at its base, while the intermediate slit is relatively easily broken or fractured when a respective bottle is tilted and twisted and pulled downwardly to remove it from the carrier.

This invention is related to the inventions described in copending application filed Jun. 30, 1994 by Linda A. Bernstein entitled Paperboad Bottle Carrier, Ser. No. 08/269,328 hereby incorporated by reference.

DETAILED DESCRIPTION OF THE INVENTION

Figure 1:
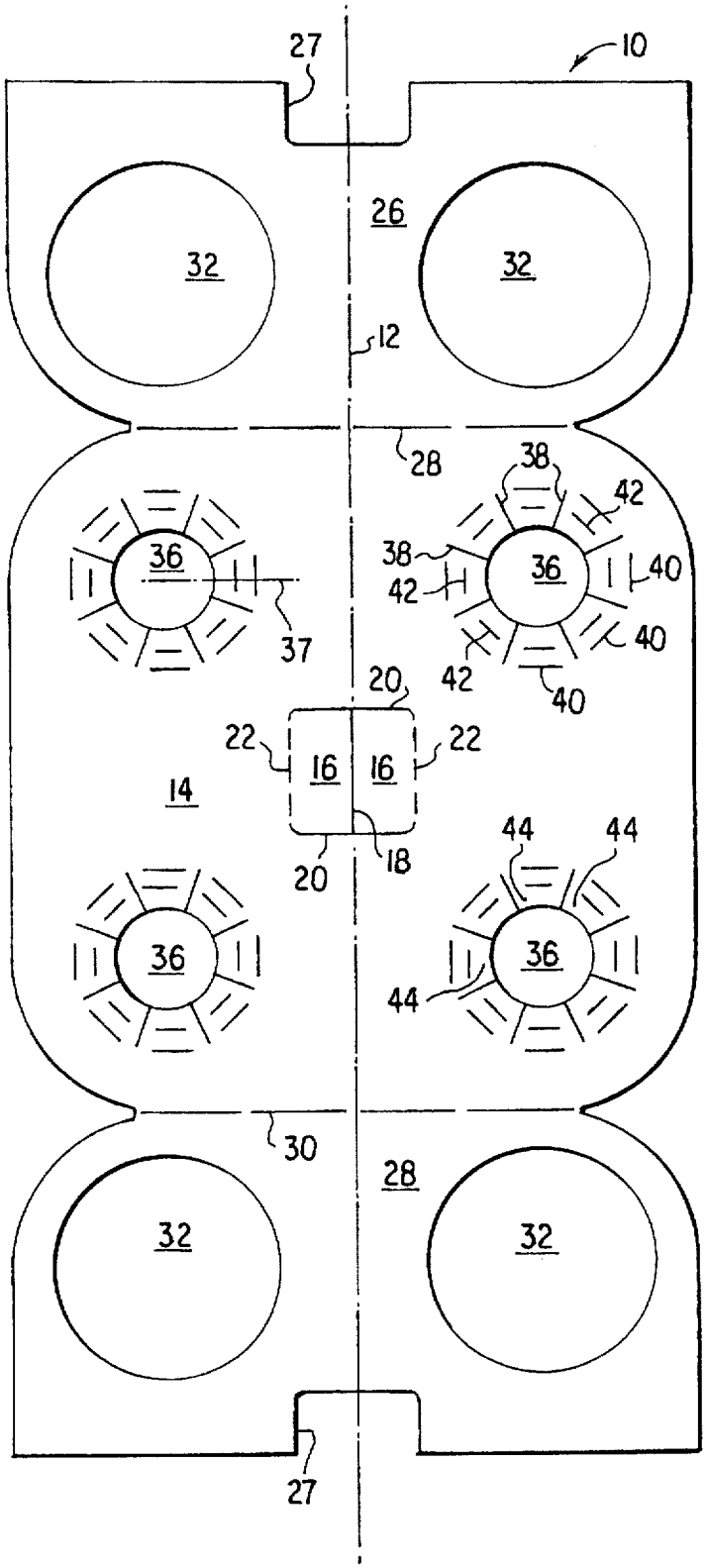
FIG. 1 is a plan view of a unitary blank of paperboard or other stiff, foldable, and resilient sheet material from which the bottle carrier of this invention is fashioned.

Referring now to FIG. 1 of the drawings, the numeral 10 denotes generally a unitary blank of paperboard or other stiff, foldable and resilient sheet material such as 57#/69# Kraft paperboard, typically of a caliper 0.030 to 0.032 inches. Blank 10 is generally rectangular and is mirror symmetrical to the left and right with respect to a vertical or longitudinal axis 12. Central panel 14 is provided at its center with two trap door type flaps 16 defined by a central cut 18 through the paperboard and collinear with axis 12, two parallel cuts 20 through the paperboard, and two parallel score or fold lines 22. Each quadrant of panel 14 is provided with a bottle receiving opening 36 whose periphery is defined by the radially innermost tips of radial fingers made by radial slits 38 extending through the paperboard. The base or widest portion of each finger is provided with a base slit 40. Another and intermediate slit 42 is located about half way along the length of each radial finger 44, with slits 40 and 42 being parallel to each other, both extending through the paperboard, and located midway of the width of a respective radial finger. A typical dimension of panel 14 is 5.625 inches on each side, as from scores 28 to 30, and a typical length of slits 40 and 42 is 0.125 inches. Openings 32 are typically of 1.8125 inches in diameter. Edge notches 27 in end panels 26 and 28 permit flaps 16 to swing downwardly, as will be explained.

Figure 2:
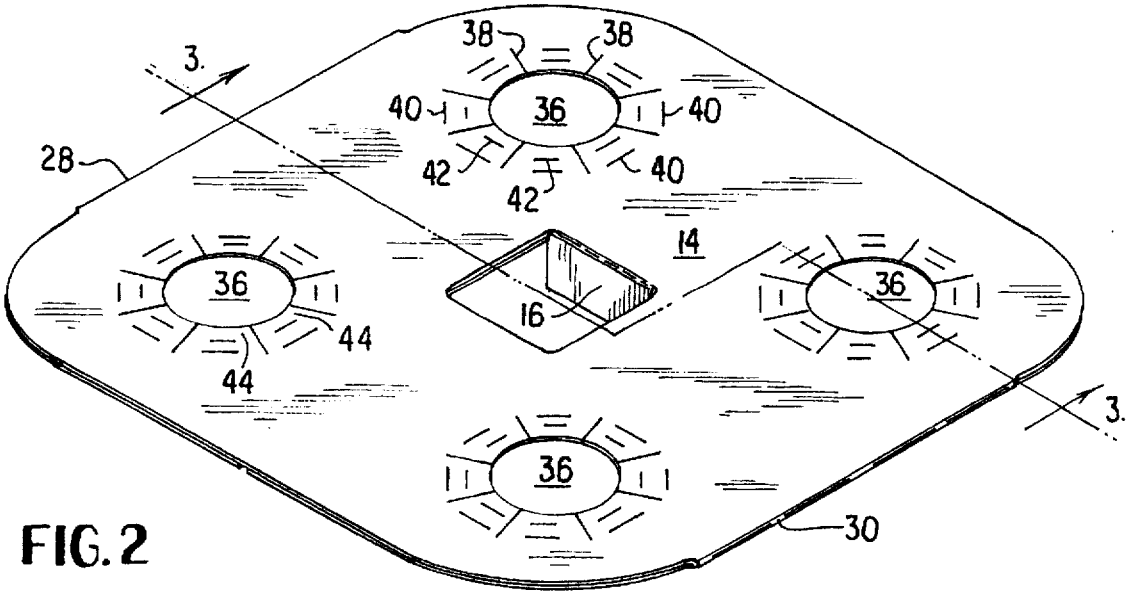
FIG. 2 is a view similar to FIG. 1 and shows the blank of FIG. 1 after it has been folded about two parallel fold lines and glued, ready to be loaded with bottles.

Referring now to FIG. 2, the blank of FIG. 1 has been folded about fold lines 28 and 30, with panels 26 and 28 glued against the bottom surface of panel 14. Trap door flaps 16 may now be bent down, or may be bent down by the consumer at the point of purchase. Notches 27 receive flaps 16, permitting the latter to bend down beneath the plane of panels 26 and 28. The corners of the central finger opening defined by flaps 16 may be curved. Openings 32 of panels 26 and 28 are coaxial with respective bottle openings 36. Panels 26 and 28 are seen to reinforce upper panel 14.

Figure 3:
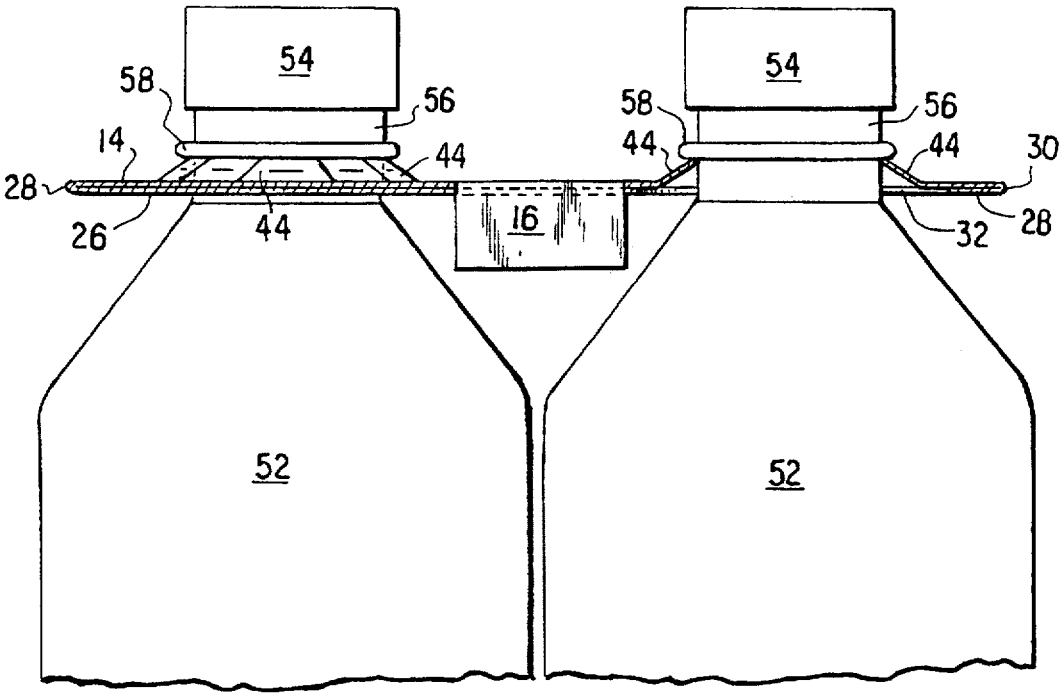
FIG. 3 is a view taken along section 3—3 of FIG. 2 and illustrates plastic bottles inserted into the carrier.

FIG. 3 illustrates plastic bottles 52, each typically formed by blow molding from polyethylene terephthalate (PET), placed or loaded in the carrier. Each bottle, typically, is provided with a screw cap 54, a neck 56 and an enlarged and integral ring 58 around its neck. For loading, the carrier is moved downwardly relative to the bottles, with each bottle upper portion passing upwardly relative to the plane of panel 14. The extent of the motion is such that upon completion of the loading, the tips of radial fingers 44 engage the bottom of a respective ring 58. This relation is maintained by the weight of the bottles, with the fingers 44 being under lengthwise compression. The carrier is carried by the purchaser inserting his fingers into the opening defined by panels 16. Each radial finger is slanted about 45 degrees form the plane of panel 14. While shown as at right angles to the length of each finger 44, slits 40 and 42 may be slanted so as to be at an angle with respect to the longitudinal axis 37 of each radial finger. Further, the slits 40 and 42 need not be parallel to each other. It will be noted that the diameter of caps 54 is greater than the diameter of bottle openings 36, but less than the spacing between diametrically opposite pairs of base slits 40 of any opening 36.

When the consumer desires to disengage a bottle from the carrier, the bottle is grasped, tilted and twisted and pulled downwardly. These motions result in a fracture of several of the associated radial fingers 44 at the region of intermediate slits 42, thus facilitating bottle removal.

In the event that a particular bottle design does not include ring or flange 58 on its neck, the tips of fingers 44 would then abut either the lower rim of cap 54 or would abut the bottoms of the screw threads (not illustrated) on the top of the bottle neck. According to the invention, the exact form of the abutment associated with each bottle neck 56 and engaged by the free ends or tips of fingers 44, namely, ring 58, or the bottom of cap 54, or the bottom of the screw threads, is not critical.

The number of radial fingers 44, the extent of radial cuts 38, and the number of openings 36 may all be varied for particular bottle weights and designs. Further, it will be apparent that reinforcing panels 26 and 28 may be omitted if the thickness or stiffnes of panel 14 is increased. It will be observed that the length of slits 40 and 42 is about one third of the width of any radial finger 44 at the relative locations of the slits, but this proportion may be varied. The length of slits 40 must be sufficient to facilitate bending at the finger bases, while the length of slits 42 must be sufficient to permit fracture in their regions.

Geometrical terms of orientation, such as upper, lower and the like, are used to facilitate the description and are not intended as limiting.

We claim:

1. A bottle carrier formed from a unitary paperboard panel, said panel having at least one bottle neck receiving opening, said opening having a plurality of cut lines extending through said panel and extending radially outwardly from said opening to thereby define a plurality of radially extending fingers, tips of said radially extending fingers terminating at said opening, each said radially extending finger having a base slit at its base or widest portion, each of said radially extending fingers having an intermediate slit about midway along its length, whereby a bottle can be engaged in said opening and wherein a bottle has an upper portion of greater diameter than the diameter of said opening but whose said upper portion diameter is less than the distance between generally pairwise opposite diametrical base slits, whereby a bottle can be readily removed from the carrier by fracture of several of said fingers at the region of said intermediate slits.

2. The carrier of claim 1 wherein said base and intermediate slits extend through said paperboard panel.

3. The carrier of claim 1 wherein said base and intermediate slits are parallel to each other, said slits being generally at right angles to the length of each said radially extending finger.

4. The carrier of claim 1 including a bottle having a neck, said neck extending through said opening, an abutment contiguous to said neck, said tips of said radial fingers engaging said abutment, said radially extending fingers tilted upwardly with respect to said panel.

5. The carrier of claim 1 including a pair of reinforcing, apertured panels glued to surface portions of said panel, said reinforcing, apertured panels each foldably connected to said paperboard panel.

6. The carrier of claim 1 including means on said carrier to facilitate carrying it by a consumer.

7. The carrier of claim 6 wherein said means is defined by a central opening in said panel through which the fingers of a consumer can be inserted.

8. The carrier of claim 4 wherein said fingers are straight.

* * * * *